United States Patent [19]

Boyle

[11] 4,056,210

[45] Nov. 1, 1977

[54] SPLASH PROOF DRINK THROUGH BEVERAGE CONTAINER LID

[75] Inventor: Patrick T. Boyle, Baltimore, Md.

[73] Assignee: Maryland Cup Corporation, Owings Mills, Md.

[21] Appl. No.: 722,402

[22] Filed: Sept. 13, 1976

Related U.S. Application Data

[63] Continuation-in-part of Ser. No. 678,751, April 21, 1976, abandoned.

[51] Int. Cl.[2] ..... A47G 19/22; B65D 41/32; B65D 83/00

[52] U.S. Cl. ..... 220/90.4; 220/268; 229/7 R

[58] Field of Search ..... 220/90.4, 90.2, 89 A, 220/266, 268, 269, 270; 229/7 R

[56] References Cited

U.S. PATENT DOCUMENTS

| | | | |
|---|---|---|---|
| 2,152,322 | 3/1939 | Moore | 229/7 R |
| 2,209,663 | 7/1940 | Reidel | 220/1 BC |
| 2,399,241 | 4/1946 | Merkle | 229/7 R |
| 3,227,304 | 1/1966 | Asbury | 220/268 |
| 3,301,459 | 1/1967 | Gardner | 220/90.6 |
| 3,362,569 | 1/1968 | Geiger | 220/268 |
| 3,410,436 | 11/1968 | Foss et al. | 215/253 |
| 3,777,968 | 12/1973 | Law | 229/7 R |
| 3,800,999 | 4/1974 | Serritella | 222/541 |
| 3,994,411 | 11/1976 | Elfelt et al. | 220/90.4 |

*Primary Examiner*—William Price
*Assistant Examiner*—Steven M. Pollard
*Attorney, Agent, or Firm*—Birch, Stewart, Kolasch & Birch

[57] ABSTRACT

A sheet plastic lid for open-mouthed containers with a tear-away section therein is provided in which the tear-away section is removable by an upward and outward motion. A raised central area of the central web of the lid merges with the top surface of the rim or bead cavity and contains score lines defining a central tear tab and a major portion of the tear-away section, the lines diverging and stopping substantially inboard of the top surface of the bead cavity. Then with the lid on a container, when the tab is freed by penetrating the raised area at the innermost score lines it is pulled upward and outward to constrain the divergent score lines to effect predictable tears through the bead or rim cavity structure to remove the tear-away segment and leave the remainder of the lid intact on the container.

20 Claims, 8 Drawing Figures

SPLASH PROOF DRINK THROUGH BEVERAGE CONTAINER LID

This application is a continuation in-part of copending application Ser. No. 678,751, filed Apr. 21, 1976 of Patrick T. Boyle for SPLASH PROOF DRINK-THROUGH BEVERAGE CONTAINER LID, now abandoned.

FIELD OF THE INVENTION

This invention relates to lids for disposable beverage containers and the like and more particularly to a plastic thermo-formed lid having a tear-away section therein to permit beverage to be consumed from the container by drinking through a tear-away section of the lid without removing the lid therefrom.

BACKGROUND OF THE INVENTION

Hot beverages and the like are constantly being served in environments in which an accidental spill can result in a painful injury, property damage, and other undesirable results.

For example, on airlines, trains and the like, it is customary to serve both hot and cold beverages to passengers. Quite often, these beverages are served in disposable paper or plastic drinking cups or containers which may or may not be provided with lids to retain the heat in the hot drinks or provide a straw slot for the cold drinks.

It has been often attempted in the prior art to provide a satisfactory tear-away segment or portion of a snap on thermoformed plastic lid such that a person can leave the lid on the beverage container and drink through the torn away segmental portion. This would give ready access to the contents of the container while substantially reducing the chance of spillage or splash by virtue of leaving the majority of the lid in place on the container while drinking.

Such prior art attempts to fabricate tear-away thermo-formed plastic lids required, for the most part, that the center of the lid, the bead cavity engaging the cup, includng the vertical wall of the bead cavity and outward to the rim of the lid, be cut or scored in order to provide a tear-away section of that lid.

This general form of construction gives rise to several standing problems in the art: first, it is very difficult to consistently and successfully place a cut in the vertical or substantially vertical walls of a bead cavity and provide a good consistent tearing of the vertical wall in the removal of the segment of the lid; second, it is difficult to score the vertical wall of the lid in high speed production such as thermo-forming and third, the prior art lids are designed to be torn from the outside in, ie.g., from the rim of the bead cavity toward the center of the lid, and with this type of tearing motion one cannot achieve a consistently uniform tear, thereby rendering an undesirable cosmetic affect to this type lid for consumer use.

It is therefore an object of the present invention to provide a new and novel thermo-formed lid of plastic or plastic foam sheet material having a tear-away segment defined therein which will consistently tear off the led and leave a predictable portion of the lid on the container.

It is another object of the present invention to provide a new and novel thermo-formed sheet plastic or foam sheet plastic lid which is readily adaptable to high speed thermo-formed production methods and which will result in a consistent and uniform end product.

Yet another object of the present invention is to provide a new and novel plastic or foam sheet plastic thermo-formed lid for disposable beverage containers and the like having a removable tear-away segment which is removable by tearing with an inside to outside motion.

These an other objects of the present invention will become more fully apparent with reference to the following specification and drawings which relate to a preferred embodiment of the invention.

SUMMARY OF THE INVENTION

A cup lid is made from polystyrene sheet or foam material using standard thermo-forming procedures in the preferred embodiment of the present invention. The central portion of the lid is raised to the same level as and connected with the top of the bead cavity or sealing curl which fits over the upper lip or bead of a beverage container.

The central portion of the lid may include a major depressed portion and a minor depressed portion defining the raised or elevated central portion in the lid, said central portion having a major central area and two divergent arms of the same height extending therefrom. This elevated central portion is flat and extends in a common plane with the top of the annular bead cavity about the lid. The arms of the raised central portion extend from the major central area to a smooth transistion into the upper surface of the bead cavity and subtend an angle of about 60° of arc of the periphery of the lid. The top surfaces of the arms comprise flat surfaces and the arms are channel shaped in cross-section.

Score lines or intermittent cuts extend from the major central portion of the raised area through the axis and top surface of each of the arms to a point inside of the bead cavity of the lid, whereby there are no score marks or indentations in the tip of the bead cavity or in the vertical or substantially vertical peripheral skirt portion or outer rim portion of the lid. These intermittent cut or score lines are joined by a cross score line or intermittent cut line in the major central area of the horse shoe shaped raised surface of the lid and if desired, two additional score lines or intermittent cut lines may extend in a divergent fashion from opposite ends of the connecting score line above-mentioned further into the major portion of the raised major central area and away from said divergent arms.

The cross score or cut line is substantially parallel to the cord of the arc subtended by the divergent arms.

Now, by pressing inward on the cross score line in the raised major central area of the lid, access is made to the interior of the lid beneath the tear away sector defined by the divergent arms of the elevated central portion and upward pressure thereon will cause the intermittent cut or score lines in the divergent arms to tear. Continued pulling and lifting of the tear-away segment will cause a predictable and consistent tearing-away of the entire segment of the lid through the bead cavity down the annular skirt and through the rim of the lid such that the entire segment will be removed therefrom.

The score lines or intermittent cuts may either be placed in the raised central portion of the lid during the thermo-forming process in the thermo-forming mold or by a separate forming step such as by the use of a steel rule die as is generally known in the art.

In alternate embodiments of the present invention the score line configuration where tearing of the tab is initiated may be formed in a raised area having no depressed portion of the lid between it and the rim of the lid. Either a set of divergent score lines or a continuous score line configuration is provided.

DETAILED DESCRIPTION OF THE DRAWINGS

Figure 1:
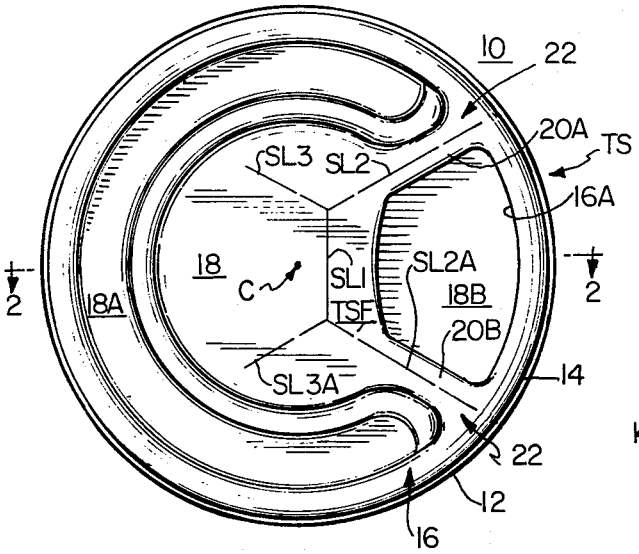
FIG. 1 is a top plan view of a preferred embodiment of the invention in which the score or intermittent cut lines of the tear-away segment are rectilinear.
Figure 3:
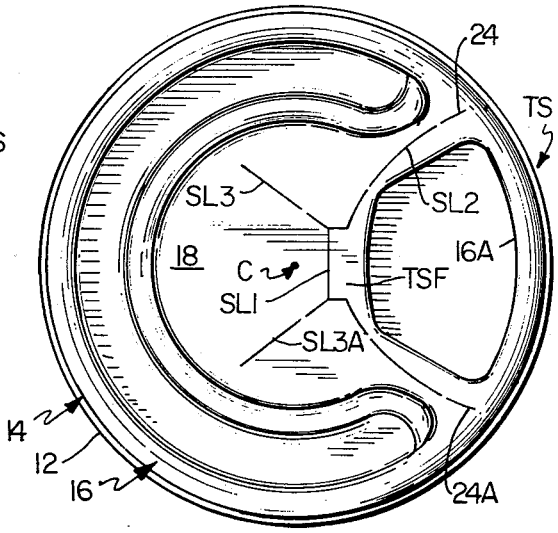
FIG. 3 is a top plan view of another preferred embodiment of the present invention in which arcuate score lines are utilized to define the tear-away segment of the lid.
Figure 2:
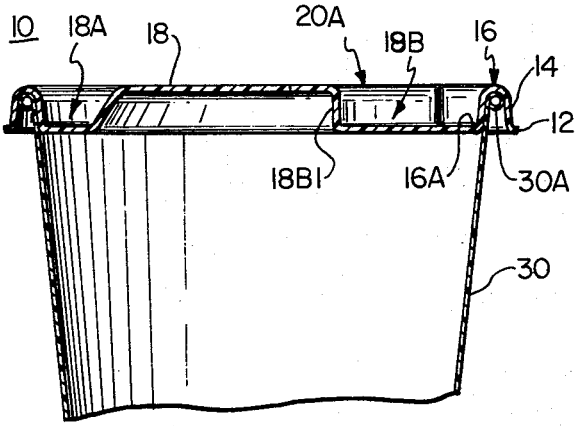
FIG. 2 is a cross section taken along line 2—2 of FIG. 1.

Referring in detail to the drawings and with particular reference to FIGS. 1, 2 and 3, a tear-away segment type lid 10 of the present invention as illustrated as including an outer rim portion 12 and an annular dependent skirt portion 14 which depends from the upper surface of a bead cavity generally indicated at 16. The lid 10 further includes a raised major central area 18 which is surrounded by major and minor depressed portions 18A and 18B, respectively, which are so shaped and so proportioned as to define between and adjacent extremities thereof first and second divergent arms 20A and 20B which are extensions of the raised surface 18 and which merge smoothly at the point generally indicated by the arrows 22 with the top surface of the bead cavity 16. These arms subtend an arc of about 60° of the periphery of the lid in a preferred embodiment.

A center point C for the lid 10 is defined in the raised major central portion area 18 of the lid 10 to illustrate the relationship of the various components of the lid to the overall construction thereof.

To the right of the center C as shown in FIGS. 1 and 3 is provided a vertical slit or score line segment SL1 (oriented parallel to the cord of the arc subtended by the arms 20A, 20B), from the top end of which are two tear lines SL2 and SL3 the former tear line extending outwardly and axially of the radially extending arm 20A and latter extending upward and to the left into the raised major central area 18 beyond the center point C. A mirror image of similar score lines is provided at the opposite end of the vertical score line SL1 in the form of tear lines SL3A and SL2A, the latter extending axially along the raised surface of arm 20B from the raised central portion 18. In the embodiment of FIG. 3 the tear lines SL2 and SL2A are arcute in shape while in FIG. 1 they are straight lines. Also, the arcuate tear lines SL2 and SL2A have end portions SL2B and SL2AB which are perpendicular to the ends of the score line segment SL1 to define a teartab portion TSF. Such a tab portion TSF is also defined between the score line segment SL1 and tear line segments SL2 and SL2A of FIG. 1 but in a wider configuration than that of FIG. 3. The function of this tear-tab TSF will be more fully described hereinafter.

The radially extending tear lines SL2 and SL2A extend from the upper and lower ends of the vertical score line or cut segment line SL1 to points intermediate the inner boundary 16A of the bead cavity 16 and the outer skirt 14 thereof. In other words, the tear lines SL2 and SL2A do not extend over the top curl and down the side wall or skirt portion of the bead cavity 16 but stop short of the sealing curl portion of the latter.

Figure 4:
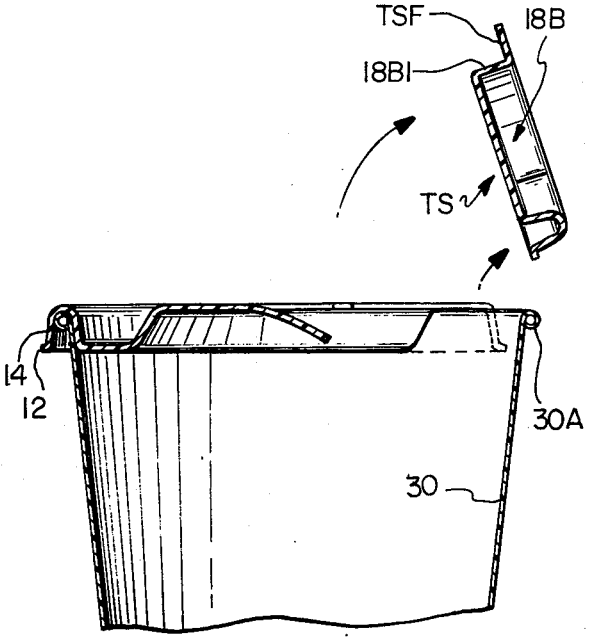
FIG. 4 is a cross section similar to that of FIG. 2 illustrating the tear-away segment of the lid being removed therefrom.

The portion of the lid 10 bounded by the cut or score lines SL1, SL2, SL2A and that portion of the outer periphery 12, 14 and 16 subtended thereby comprises a tear-away segment TS as generally illustrated in FIGS. 1, 3 and 4.

In operation, assuming that as shown in FIGS. 2 and 4 the lid 10 is positioned upon the top bead 30A of a container 30, the tear away segment TS of the lid 10 is removed as follows:

The thumb nail or finger nail or a plastic straw or other implement is placed beneath the inner edge of the tear-away segment TS defined by the vertical line segment SL1 by depressing the portion of the raised center section 18 between the score lines SL3 and SL3A to thereby achieve a purchase on the tear-away segment TS at a flap or tab portion TSF thereof between the center C of the lid 10 and minor depressed portion or cavity 18B in the tip of the said lid 10.

The flap portion TSF is pulled upwardly and outwardly in a direction illustrated in FIG. 4 causing the intermittent cut score lines SL2 and SL2A to fracture along their own lengths and commence a predictable fracture or tear through the top of the bead cavity 16 down the outer skirt portion 14 and through the rim 12 to thereby permit the complete removal of the tear-away section TS from the lid 10, leaving the remainder of the lid 10 firmly fixed on the container 30 by the interaction of the bead cavity 16 and top curl or bead 30A.

The sidewall portions 18B1 bounding the tab portion TSF and the divergent arms 20A, 20B on three sides of the minor depressed portion 18B are substantially vertically formed, i.e., steep, to lend stiffness to the tear-away section TS. This enhances the reliability and consistency of the tear-away function.

Figure 5:
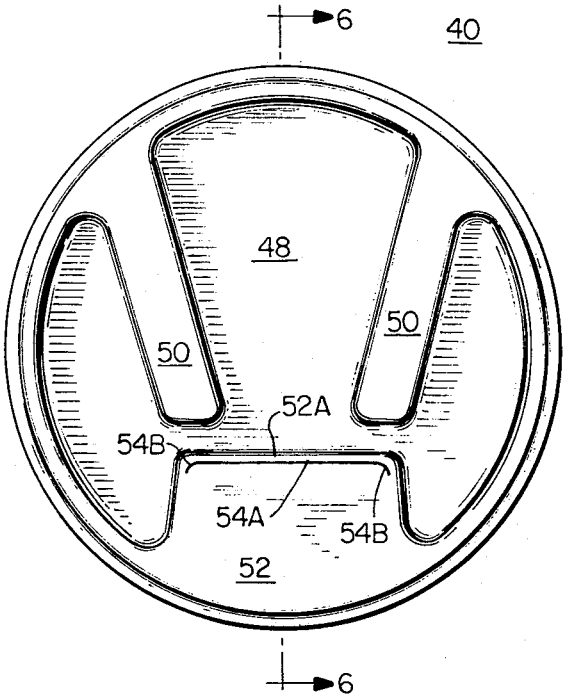
FIG. 5 is a top plan view of a lid having a continuous score line configuration adjacent a depressed area of the lid.
Figure 6:
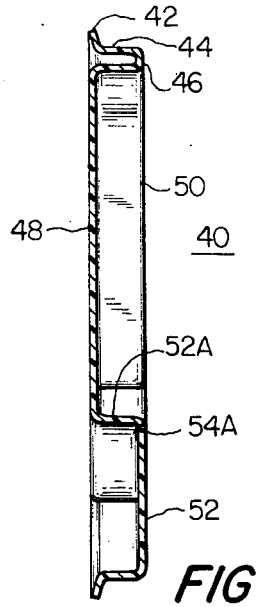
FIG. 6 is a cross section taken along line 6—6 of FIG. 5.

Refering to FIGS. 5 and 6, a lid 40 is shown a flared edge portion 42, dependent skirt 44 and bead cavity 46 around the periphery thereof, the major portion of the central web 48 of the lid 40 being depressed in a clover leaf configuration delineated by two raised ribs 50 and a raised tear-tab surface 52 having an elongated and abrupt inboard shoulder 52A disposed as a partial cord of an arc across the periphery of the lid 40 and substantially subtending the entire raised area 52 which extends from the shoulder 52A to the bead cavity 46 at the same level as the upper extermity of the latter.

The cut or score-line configuration includes an elongated main inboard portion 54A substantially coterminous with the shoulder 52A with end portions or pilot cuts or score-lines 54B continuing therefrom and turning toward the outer periphery of the lid 40.

Thus, by attacking the score line 54A from the inboard side of the inboard shoulder 52A with a thumb-nail or other implement and lifting upward on the raised area 52, it will be constrained to fracture along the direction dictated by the pilot lines 52B and tear away over the entire width of the main portion 54A through the bead cavity 46, shirt 44 and edge 42, to remove a tab-shaped drink-through area from the lid 40.

Figure 7:
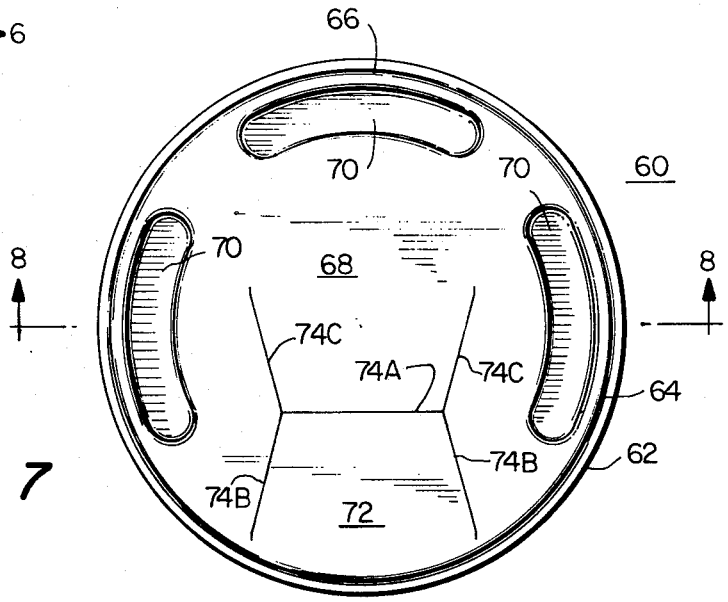
FIG. 7 is a top plan view of another embodiment of a lid with a divergent score line configuration with no depressed area in the tear tab.
Figure 8:
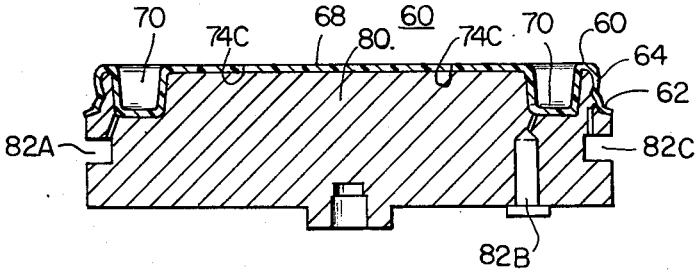
FIG. 8 is a cross section taken along line 8—8 of FIG. 7 illustrating vacuum forming of the lid of FIG. 7.

Referring next to FIGS. 7 and 8, a lid 60 is shown with flared edge 62, dependend 64, bead cavity 66 and a raised major portion 68 of its central web having arcuate stiffening depressions 70 formed therein around selected segments of the periphery thereof.

A tab portion 72 of the raised web 68 is at the same level as the top of the bead cavity 66 and includes a main cord-oriented inboard cut or score-line **74*a* and outwardly extending pilot cut or score lines 74B extending from the ends of the main line 74A divergently toward the periphery of the lid 60. Cut or score-lines 74C disposed substantially as mirror images of the pilot lines 74B extend inwardly of the central raised area 68 to assist in initiating a tear tab operation of the lid 60 in substantially the same manner as the lines SL3 and SL3A of FIGS. 1 – 4**.

As in the other embodiments, the tear tab operation is effected by grasping the tab area 72 at the inboard cut or scoreline 74A and pulling upward to induce a fracture through and in the direction of the pilot lines 74B, which fractures continue through the bead cavity 66, skirt 64 and flared edge 67 of the lid 60 to provide a drinking or access opening there through of predictable uniformity.

FIG. 8 illustrates vacuum forming if the lid 60 in a forming mold 80 having vacuum parts 82A, 82B and 82C to draw this depressed area 70, skirt 64 and edge 62 of the lid 60 omits contact with the mold 80 as known in the art.

The location of the inboard pilot cuts or score lines 74C are illustrated in FIG. 8 and may be formed during thermo forming or subsequently as desired.

The foregoing structure for a tear away lid provides a solution to long standing problems in the art which primarily involve the manufacturing process for such lids. Heretofore, no lid has been provided with an outward tearing motion which is made possible by the present invention and which outward tearing motion is also embodied in a structure which requires no vertical cuts to be placed in the bead cavity or dependent skirt portion or flared edge portion which are basically present in all snap on flexible plastic lids of either the regular or foamed sheet type.

The present invention may be modified as would occur to one of ordinary skill in the art without departing from the spirit and scope of the present invention.

What is claimed is:

1. A flexible plastic lid for open mouthed containers having an annular bead or rim defining the open mouth thereof, comprising:

a rim receiving annular bead cavity formed in the outer periphery of said lid and having an upper surface for overlying a container rim and a dependent annular skirt outboard of said upper surface;

a central web portion bounded by said bead cavity having a raised central area defined therein connected to and at substantially the same level as said upper surface by a pair of divergent arms formed in said central web and including a respective pair of raised elongated surface areas merging with said upper surface and said raised central area; and finite score line means formed in said raised central area substantially transversely oriented with respect to said divergent arms and a pair of tear line means defined one in each of said upper surfaces of said divergent arms, said tear line means extending from respectively opposite ends of said score line means to a point substantially inboard of the said upper surface of said bead cavity;

said score and tear line means defining tear tab means in said raised central area and a wedge shaped tear-away segment in said lid.

2. The invention defined in claim 1, wherein said tear-away segment is removable from said lid by an upward and outward force on said tear tab.

3. The invention defined in claim 1, wherein said tear-away segment is removable from said lid by an upward and outward force on said tear tab; and said tear line means is responsive to said force on said tear tab to induce a pair of substantially predictable tear lines through said bead cavity.

4. The invention defined in claim 1, wherein said tear-away segment includes a substantially steep-walled cavity defined between said raised central area, said divergent arms and said bead cavity, the said steep walls of said cavity providing substantial rigidity to said tear-away segment outboard of said tear tab.

5. The invention defined in claim 4, wherein said tear-away segment is removable from said lid by an upward and outward force on said tear tab.

6. The invention defined in claim 4, wherein said tear-away segment is removable from said lid by an upward and outward force on said tear tab; and said tear line means is responsive to said force on said tear tab to induce a pair of substantially predictable tear lines through said bead cavity.

7. The invention defined in claim 1, wherein said tear lines define arcuate paths from said score line along said upper surfaces of said divergent arms.

8. The invention defined in claim 7, wherein said tear lines further include end portions merging in substantially perpendicular relationship to said score line to define a tear tab in said raised central area.

9. The invention defined in claim 7, wherein said tear-away segment is removable from said lid by an upward and outward force on said tear tab.

10. The invention defined in claim 7, wherein said tear-away segment is removable from said lid by an upward and outward force on said tear tab; and said tear line means is responsive to said force on said tear tab to induce a pair of substantially predictable tear lines through said bead cavity.

11. The invention defined in claim 1, wherein said lid further includes a second pair of divergent tear lines defined in said central area extending from the ends of said score line in substantially opposite directions to the first said pair of tear lines to enhance penetration of said lid to expose said tear tab.

12. The invention defined in claim 11, wherein said tear-away segment is removable from said lid by an upward and outward force on said tear tab.

13. The invention defined in claim 11, wherein said tear-away segment is removable from said lid by an upward and outward force on said tear tab; and said tear line means is responsive to said force on said tear tab to induce a pair of substantially predictable tear lines through said bead cavity.

14. The invention defined in claim 11, wherein said tear-away segment includes a substantially steep-walled cavity defined between said central area, said divergent arms and said bead cavity, the said steep walls of said cavity providing substantial rigidity to said tear-away segment outboard of said tear tab.

15. The invention defined in claim 14, wherein said tear-away segment is removable from said lid by an upward and outward force on said tear tab.

16. The invention defined in claim 14, wherein said tear-away segment is removable from said lid by an upward and outward force on said tear tab; and said tear line means is responsive to said force on said tear tab to induce a pair of substantially predictable tear lines through said bead cavity.

17. A friction fit sheet plastic lid for open mouthed containers having a peripheral lid receiving rim portion about the mouth thereof comprising:

a peripheral rim receiving cavity defined therein;

a central web bounded by said rim cavity;

a raised area formed in said central web;

an upper surface on said rim cavity at substantially the same height as said raised area and merging therewith over at least a predetermined peripheral portion; and a wedge shaped tear-away section having a tear-tab at its innermost extremity defined by score lines which diverge to substantially subtend said predetermined peripheral portion and which terminate substantially inboard of said upper surface of said bead cavity;

said tear-away section and said predetermined peripheral portion being removable from the remainder of said lid by an upward and outward force on said tear tab.

18. A flexible plastic lid for open mouthed containers having an annular bead or rim defining the open mouth thereof, comprising:

a rim receiving annular bead cavity formed in the outer periphery of said lid and having an upper surface for overlying a container rim and a dependent annular skirt outboard of said upper surface;

a central web portion bounded by said bead cavity having a raised area defined therein connected to and at substantially the same level as said upper surface; and finite score line means formed in said raised area substantially transversely oriented there across to subtend a given peripheral portion of said bead cavity, the length of said score line means defining the transverse dimension of a tear tab means in said raised area; and said tear tab means in said raised area being responsive to an upward and outward pressure thereon at said score line means to cause said tear tab means to predictably tear away from said raised area and through said bead cavity to remove said given peripheral portion.

19. A friction fit sheet plastic lid for open mouthed containers having a peripheral lid receiving rim portion about the mouth thereof comprising:

a peripheral rim receiving cavity defined therein:

a central web bounded by said rim cavity;

a raised area formed in said central web;

an upper surface on said rim cavity at substantially the same height as said raised area and merging therewith over at least a predetermined peripheral portion; and a tear-away section having a tear-tab at its innermost extremity by a score line configuration which substantially subtends said predetermined peripheral portion and which terminates substantially inboard of said upper surface of said bead cavity;

said tear-away section and said predetermined peripheral portion being removable from the remainder of said lid by an upward and outward force on said tear tab.

20. The invention defined in claim 19, wherein said score line configuration comprises a straight cut through said raised area with outboard ends turned toward said bead cavity to define the direction of predictable tear lines through said raised area and said beand cavity.

* * * * *

UNITED STATES PATENT AND TRADEMARK OFFICE

CERTIFICATE OF CORRECTION

PATENT NO. : 4,056,210

DATED : November 1, 1977

INVENTOR(S) : Patrick T. BOYLE

It is certified that error appears in the above-identified patent and that said Letters Patent are hereby corrected as shown below:

Column 2:

Line 8, change "an" to --and--.

Column 3:

Line 66, change "arcute" to --arcuate--.

Column 4:

Line 61, change "extermity" to --extremity--.

Column 5:

Line 8, change "dependend" to --dependent skirt--;
Line 14, change "74a" to --74A--;
Line 31, change "of" to --if--;
Line 32, change "parts" to --ports--;
Line 33, change "this" to --the--;
Line 34, change "omits" to --into--.

UNITED STATES PATENT AND TRADEMARK OFFICE

CERTIFICATE OF CORRECTION

PATENT NO. : 4,056,210

DATED : November 1, 1977

INVENTOR(S) : Patrick T. BOYLE

It is certified that error appears in the above-identified patent and that said Letters Patent are hereby corrected as shown below:

Claim 20:

Column 8, line 41, change "beand" to --bead--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*